US008420557B2

(12) United States Patent
Haberer et al.

(10) Patent No.: US 8,420,557 B2
(45) Date of Patent: Apr. 16, 2013

(54) POLYETHYLENE-BASED, SOFT NONWOVEN FABRIC

(75) Inventors: Markus Haberer, Berlin (DE); Henning Röttger, Braunschweig (DE)

(73) Assignee: Fiberweb Corovin GmbH, Peine (DE)

( * ) Notice: Subject to any disclaimer, the term of this patent is extended or adjusted under 35 U.S.C. 154(b) by 0 days.

(21) Appl. No.: 11/425,340

(22) Filed: Jun. 20, 2006

(65) Prior Publication Data

US 2007/0134478 A1 Jun. 14, 2007

Related U.S. Application Data

(63) Continuation of application No. PCT/EP2004/004640, filed on Apr. 30, 2004.

(30) Foreign Application Priority Data

Dec. 20, 2003 (DE) ..... 103 60 845

(51) Int. Cl.
*D04H 1/54* (2012.01)

(52) U.S. Cl.
USPC ..... 442/409; 442/327; 442/364; 442/401

(58) Field of Classification Search ..... 442/364, 442/401, 327, 409
See application file for complete search history.

(56) References Cited

U.S. PATENT DOCUMENTS

| | | | |
|---|---|---|---|
| 2,734,375 | A | 2/1956 | Galbraith et al. |
| 3,210,451 | A | 10/1965 | Manning, Jr. et al. |
| 3,502,763 | A | 3/1970 | Hartmann |
| 3,704,198 | A | 11/1972 | Prentice |
| 3,792,944 | A | 2/1974 | Chimura et al. |
| 3,802,817 | A | 4/1974 | Matsuki et al. |
| 3,817,680 | A | 6/1974 | Gultner et al. |
| 3,849,241 | A | 11/1974 | Butin et al. |
| 3,855,046 | A | 12/1974 | Hansen et al. |
| 3,914,342 | A | 10/1975 | Mitchell |
| 3,928,920 | A | 12/1975 | Fleissner |

(Continued)

FOREIGN PATENT DOCUMENTS

| | | |
|---|---|---|
| EP | 0 259 128 | 3/1988 |
| EP | 0 260 974 | 3/1988 |

(Continued)

OTHER PUBLICATIONS

International Search Report for PCT/EP2004/004640 filed Apr. 30, 2004.

(Continued)

*Primary Examiner* — Peter Y Choi
(74) *Attorney, Agent, or Firm* — Alston & Bird LLP

(57) ABSTRACT

The present invention concerns a nonwoven fabric the fibers of which have polyethylene on at least part of their surface, where the fibers are thermally bonded and the non-woven fabric exhibits an abrasion of less than 0.5 mg/cm$^2$, in particular of less than 0.4 mg/cm$^2$, and an embossed area fraction of less than 35%, in particular of less than 28%. Furthermore a device is made available for the manufacture of a non-woven fabric, using a polyethylene-containing polymer, with a take-down system underneath a spinning plate that causes the take-down of the polyethylene, where the spinning plate has an L/D ratio of between 4 and 9.

14 Claims, 4 Drawing Sheets

U.S. PATENT DOCUMENTS

Figure 1:
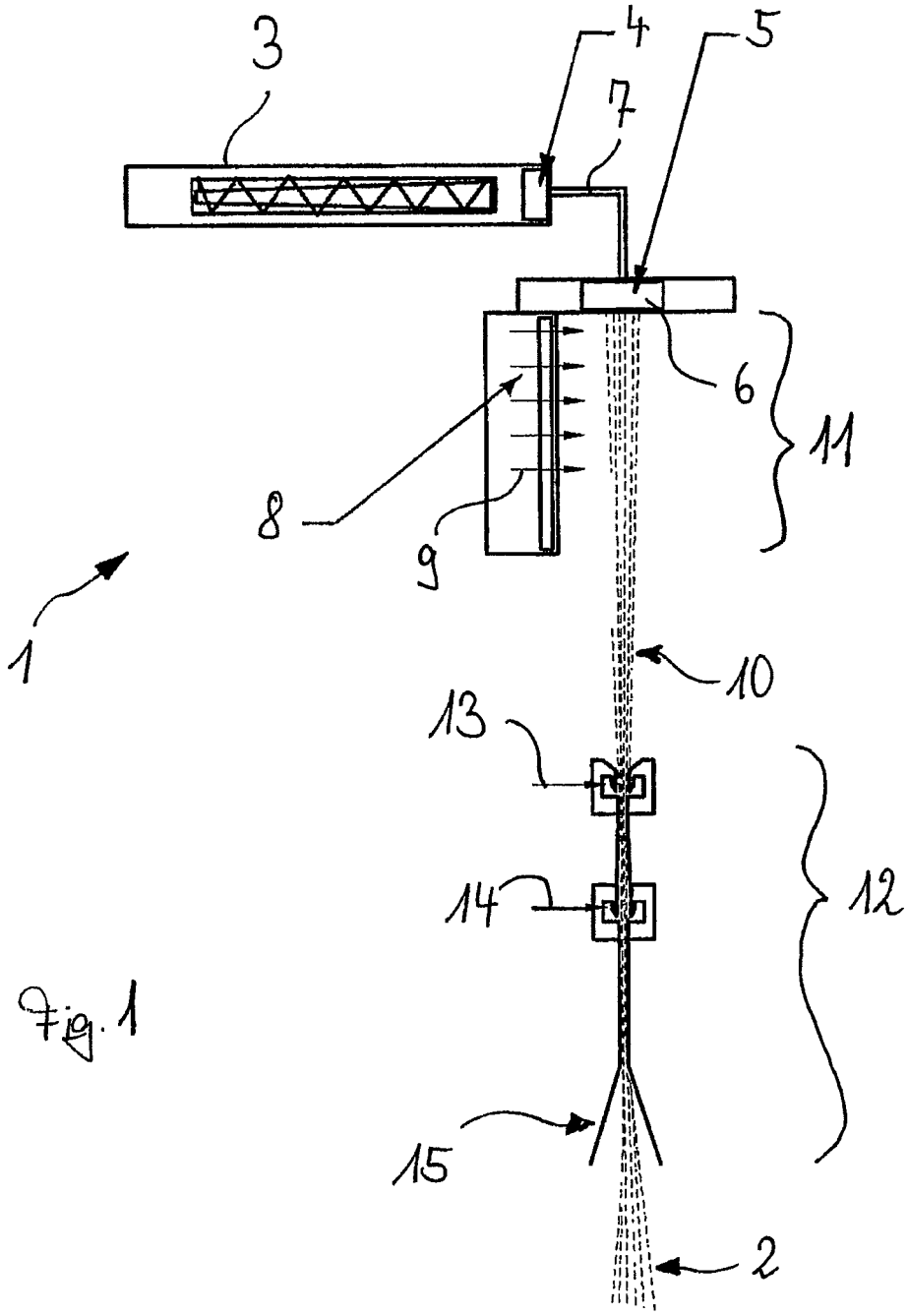

| | | | | |
|---|---|---|---|---|
| 4,021,284 | A | 5/1977 | Kalwaites | |
| 4,024,612 | A | 5/1977 | Contractor et al. | |
| 4,100,324 | A | 7/1978 | Anderson et al. | |
| 4,283,364 | A | 8/1981 | Capps et al. | |
| 4,818,464 | A | 4/1989 | Lau | |
| 5,178,931 | A | 1/1993 | Perkins et al. | |
| 5,188,885 | A | 2/1993 | Timmons et al. | |
| 5,254,299 | A | 10/1993 | Krupp et al. | |
| 5,296,184 | A | 3/1994 | Wu et al. | |
| 5,336,552 | A | 8/1994 | Strack et al. | |
| 5,382,490 | A | 1/1995 | Yamamura et al. | |
| 5,616,408 | A | 4/1997 | Oleszczuk et al. | |
| 5,759,926 | A | 6/1998 | Pike et al. | |
| 5,770,531 | A | 6/1998 | Sudduth et al. | |
| 5,783,503 | A | 7/1998 | Gillespie et al. | |
| 5,844,045 | A | 12/1998 | Kolthammer et al. | |
| 5,869,575 | A | 2/1999 | Kolthammer et al. | |
| 5,935,512 | A | 8/1999 | Haynes et al. | |
| 6,207,602 | B1 | 3/2001 | Gessner et al. | |
| 6,417,121 | B1 | 7/2002 | Newkirk et al. | |
| 6,448,341 | B1 | 9/2002 | Kolthammer et al. | |
| 7,179,412 | B1 | 2/2007 | Wilkie et al. | |
| 2001/0003693 | A1 | 6/2001 | Gillespie | |
| 2001/0051267 | A1 | 12/2001 | Maugans et al. | |
| 2002/0019490 | A1 | 2/2002 | Maugans et al. | |
| 2002/0114857 | A1 | 8/2002 | Yamashita et al. | |
| 2002/0117770 | A1 | 8/2002 | Haynes et al. | |
| 2002/0119720 | A1* | 8/2002 | Arora et al. | 442/327 |
| 2002/0132923 | A1 | 9/2002 | Langohr et al. | |
| 2002/0144384 | A1 | 10/2002 | Maugans | |
| 2002/0148578 | A1 | 10/2002 | Reilly et al. | |
| 2003/0149180 | A1 | 8/2003 | Van Dun et al. | |
| 2005/0164586 | A1* | 7/2005 | Autran et al. | 442/361 |
| 2005/0165173 | A1* | 7/2005 | Autran et al. | 525/333.7 |
| 2007/0173162 | A1* | 7/2007 | Ethiopia et al. | 442/327 |

FOREIGN PATENT DOCUMENTS

| | | | |
|---|---|---|---|
| EP | 0 309 073 | | 3/1989 |
| EP | 0 527 489 | | 2/1993 |
| EP | 1 039 007 | | 9/2000 |
| EP | 1 790 467 | A1 | 5/2007 |
| JP | 63-275767 | A | 11/1988 |
| JP | 01-049819 | B | 10/1989 |
| JP | 3-193958 | A | 8/1991 |
| JP | 2002 138359 | | 9/2002 |
| JP | 2003-519296 | T | 6/2003 |
| WO | WO 93/07187 | | 4/1993 |
| WO | WO 93/07188 | | 4/1993 |
| WO | WO 94/07189 | | 3/1994 |
| WO | WO 96/19346 | | 6/1996 |
| WO | WO 02/31245 | | 4/2002 |
| WO | WO 2005/111291 | A1 | 11/2005 |

OTHER PUBLICATIONS

Office Action for Japanese Application No. 2006-544225 dated Sep. 2, 2010.

Office Action for U.S. Appl. No. 12/363,922 dated Aug. 19, 2011.

Office Action for U.S. Appl. No. 12/363,912, mailed Apr. 1, 2011; 16 pages.

Office Action for U.S. Appl. No. 12/363,922, mailed Apr. 14, 2011; 10 pages.

Office Action for U.S. Appl. No. 12/363,922 dated Mar. 19, 2012.

* cited by examiner

POLYETHYLENE-BASED, SOFT NONWOVEN FABRIC

CROSS-REFERENCE TO RELATED APPLICATIONS

This is a continuation of PCT International application PCT/EP2004/004640, filed Apr. 30, 2004, claiming priority from German Application No. 10360845.1, filed Dec. 20, 2003.

BACKGROUND OF THE INVENTION

The present invention concerns a nonwoven fabric the fibers of which have a polyethylene at least on their surface, with the fibers being thermally bonded. Furthermore claimed is a device for the manufacture of a nonwoven fabric using a polyethylene-containing polymer, and a procedure for the manufacture of a nonwoven fabric the fibers of which have polyethylene at least on part of their surface.

Because of their multiple applications, nonwoven fabrics have the most varied applications. Because of their multiple influence parameters, these properties can often be determined only by means of elaborate tests, where in addition to the effects of the polymer material used, also machine effects, ambient conditions and other parameters have to be taken into account. For instance, a nonwoven fabric is obtained from WO 02/31245 A2 that presumably is particularly soft. A nonwoven fabric is obtained based on multiple experimental parameters that are supposedly manufactured with a consolidation surface area of at least 30% of the nonwoven fabric surface area and an abrasion coefficient of less than 0.30 mg/cm$^2$. To make such a material possible, a pre-consolidated nonwoven fabric is passed though a first and then a second calender, where thermal bonding takes place in both calenders. In a calender placed downstream, the material thus doubly consolidated is stretched essentially in CD direction, before being spooled and transported for further processing.

It is the task of the present invention to make available a nonwoven fabric that on the one hand feels soft and on the other is sufficiently robust for numerous applications; the manufacture of the nonwoven fabric should be as economical as possible.

SUMMARY OF THE INVENTION

Certain embodiments of the present invention satisfy at least some of the aforementioned tasks by providing a soft yet robust nonwoven fabric.

In accordance with the invention, a nonwoven fabric is proposed the fibers of which have a polyethylene at least on the surface, where the fibers are bonded and the nonwoven fabric has an abrasion rate less than 0.8 mg/cm$^2$. The fibers preferably consist essentially of polyethylene.

The nonwoven fabric is preferably thermally bonded only once. According to one implementation the nonwoven fabric has an abrasion resistance rate less than 0.2 mg/cm$^2$, especially in the range between 0.2 to 0.09 mg/cm$^2$. A further implementation comprises a nonwoven fabric with a consolidation area fraction of less than 0.2 mg/cm$^2$, especially less than 32%, preferably less than 28% a preferred embodiment comprises a nonwoven fabric with an abrasion rate of less than 0.3 mg/cm$^2$ and a consolidation area fraction of less than 30%. The nonwoven fabric fibers have polyethylene at least on their surface, where the fibers are thermally bonded and the nonwoven fabric shows an abrasion of less than 0.5 mg/cm$^2$, in particular of less than 0.4 mg/cm$^2$, and an consolidated surface fraction of less than 23%, in particular of less than 20%. According to one of the further developments, a nonwoven fabric can be manufactured with an abrasion of less than 0.3 mg/cm$^2$, preferably even of less than 0.2 mg/cm$^2$ and in particular, of less than 0.1 mg/cm$^2$. It is also possible to keep the consolidated area fraction to below 16%.

The abrasion is here determined as follows:

In nonwoven fabrics the abrasion is determined using a Sutherland Inc. Rub Tester, a standard instrument in the paper industry. This instrument can for instance be obtained from the Richard Schmitt Company, In der Einsteinstrasse 20, 64668 Rimbach. The Tester is described in principle also in U.S. Pat. No. 2,734,375. The measurement principle provides that a surface of the nonwoven fabric be treated with sandpaper under defined conditions and the abrasion is determined gravimetrically. Abrasion is here defined as follows: the gravimetrically determined mass of loose fiber per unit surface area [mg/cm$^2$].

To perform the abrasion determination, a Sutherland Inc. Rub Tester with a 1 kg bearing load (AGS) is required, with a holder for the sandpaper, an analytical balance with a precision of ±0.0001 g, a dinking die and stamp press, and a 2 kg hand roller. The materials required are:

Sandpaper (aluminum oxide), 320 grain, width 50.8 mm; double-side adhesive tape, from 3M, Article No. 9195, hereinafter called Tape 1; to collect the fibers, an adhesive tape, from 3M, Article No. 3126c, hereinafter called Tape 2; silicone paper; metal sheets to glue on the nonwoven fabric.

Sample preparation is performed before carrying out the test. To this end a piece of nonwoven fabric of size 20 cm×5 cm is punched out using a dinking die. Care must be taken to verify whether the nonwoven fabric is tested in the production direction (MD), or in the direction perpendicular to the production direction (CD). Thus, if the nonwoven fabric sample is to be tested in MD, then the MD must be oriented parallel to the longer side of the nonwoven fabric specimen. The test report must indicate whether the test was performed in MD or CD. When handling the nonwoven fabric specimen, care must be taken not to touch it with bare hands, to avoid surface contamination. Tape 1 has adhesive sides that adhere with different strengths. The more strongly adhering side is the side that remains covered when the tape is let out. The nonwoven fabric must be glued onto this side. To this end, the side that is uncovered during the unwinding of Tape 1 must be covered with silicone paper and the tape cut into 15 cm long pieces. The silicone paper from the more strongly adhering side of Tape 1 is removed and the nonwoven fabric is glued onto tape 1 on the side not to be tested. Note during the testing of the nonwoven fabric, that the nonwoven fabric has two sides: a smooth and an consolidated side. Hence different abrasion values can be determined for the same nonwoven fabric, depending on the side tested. Once the samples have been prepared, the nonwoven fabric thus prepared must be rolled over twice with the 2 kg hand roller. No additional force is exerted here. The sample thus prepared is next punched out to size 4 cm×11 cm, using the dinking die.

The test is performed in the following steps:

The Sutherland Inc. Rubb Tester is set to 20 test cycles, selecting velocity step 1 on the instrument. This corresponds to 42 cycles per minute. Next a 20 cm long piece of sandpaper is cut. The sandpaper is attached to the AGS of the Sutherland Inc. Rubb Tester, in such a way that the sandpaper no longer moves. Note that a new piece of sandpaper must be used for each test. Next the removable paper is peeled off the second side of tape 1 and the composite of tape 1 and the nonwoven fabric is glued onto the metal sheet provided for that purpose. The composite must be glued precisely in the marked area on the metal sheet. The nonwoven fabric is then rolled over twice with the 2 kg hand roller. No additional force is to be applied. The weight of the metal sheet and the tape 1/nonwoven fabric composite is then determined on an analytical balance to four decimal places, and recorded (G1). The AGS is then hung into the mounting support on the Sutherland Inc. Rubb Tester. Care must be taken here that the surface of the nonwoven fabric to be tested is not damaged and no unnecessary pressure is applied to it. Once the measurement has been performed, the AGS is carefully removed. Then a 20 cm long strip of tape 2 is cut and placed loosely on the specimen. Care must be taken that the adhesive side of tape 2 is not touched with bare hands. Next pass the 2 kg hand roller once over the glued-on tape 2. No additional force is applied here. Next tape 2 is pulled off the surface of the nonwoven fabric specimen. The nonwoven fabric is weighed precisely with the sample holder, to ±0.0001 g accuracy. The weight so determined is recorded as "overall nonwoven fabric weight" (G2).

Abrasion is calculated as follows:

$$\text{Abrasion } [\text{mg/cm}^2]=[1000\times(G1-G2)]/44$$

During evaluation, take into account that the results will differ depending on whether the smooth or the consolidated side of the nonwoven fabric is examined. Differences can also arise if the sample is tested once in MD and another time in CD orientation. To obtain uniform measurement results, care must be taken that the test conditions are uniform. In multiple determinations of an abrasion value, the mean value and the standard deviation are calculated. In addition, the minimum and the maximum values are recorded. The measurement precision of the calculated abrasion is reported to three decimal places.

Preferably the nonwoven fabric shows an abrasion of less than 0.3 mg/cm$^2$ on the consolidated side. According to another implementation the difference in abrasion between the consolidated and the smooth side is less than 70%. It is in particular preferred that abrasion of the consolidated side amounts to at most 50%, in particular less than 30%, of the abrasion on the smooth side of the nonwoven fabric.

In particular, the consolidated surface of the nonwoven fabric can serve as outer layer of a product, compared to the smooth side. The reduced abrasion tendency of the material makes it possible to use the nonwoven fabric in particular in applications in which a pronounced tendency to lint formation could lead to undesirable side effects.

In accordance with an additional concept of the invention, which in particular can be realized independently of the concepts above, a nonwoven fabric is made available, with fibers that have polyethylene on their surface, whereby the nonwoven material exhibits a dynamic coefficient of friction (COF: coefficient of friction) of 0.19-0.5. Preferably the dynamic coefficient of friction will be of 0.25-0.35. If the nonwoven fabric has a coefficient of friction in this range, then it can be successfully used wherever it is important to use the nonwoven fabric without a high abrasion effect.

The dynamic coefficient of friction CoF is determined using a measurement principle in which a sled is covered with a nonwoven fabric sample and then pulled in a defined manner over a level area also covered with the same nonwoven fabric. The intervening forces are recorded by a tensile tester. The standard to be consulted here is TEFO method 18-66. The dynamic coefficient of friction is here defined as follows:

$$\mu_D=F_{mittel}/(W*9.81)[(\text{kg*m*sec}^2)/(\text{kg*m*sec}^2)]$$

The dynamic coefficient of friction is thus dimensionless. The $F_{mittel}$ used is the mean force in Newton obtained by the measurement. The value W indicates the weight of the nonwoven fabric specimen $W_{Vlies}$ wrapped around the sled, added to the weight of the sled $W_{Schlitten}$. The weight of the sled is 195.3 g. In addition, the concept "friction body" is defined as "sled with attached nonwoven fabric sample" and the concept "friction table" is defined as "platform with applied nonwoven fabric".

A tensile tester—for instance a Zwick 2.5—is required to perform the test method, as well as a sled with a nylon thread and an adapter for the test machine, a platform with a turn pulley and a balance. The specimen to be tested is prepared as follows: a nonwoven fabric specimen 1 is cut to size 65×100 mm and a second nonwoven fabric 2, to size 140×285 mm. Care must be taken here that the long sides are cut either in MD or CD alignment. While carrying out the test method, the platform is attached to the tensile tester. A 100 N load cell is installed in the tensile tester. Next the nonwoven fabric specimen 1 is weighed to 0.001 g precision and the weight $W_{Viles}$ is recorded. Then the nonwoven fabric specimen 1 is cut centrally on one of the narrow sides, to a depth of 3 cm and attached to the sled using adhesive tape. Care must be taken that the adhesive tape is not on the friction side of the nonwoven fabric specimen. Furthermore, care must be taken that the orientation of the nonwoven fabric is observed, i.e., its smooth or its consolidated side are indicated. In a subsequent evaluation, care must be taken to indicate which side was used in the test.

The nonwoven fabric specimen 2 is attached to the platform using a double-sided adhesive tape. Care must be taken here too that the adhesive tape is not in the friction area of the nonwoven fabric specimen. The nonwoven fabric specimen must lie wrinkle-free on the platform, with the longer side parallel to the longer side of the platform. Here too, in the subsequent evaluation care must be taken to know what orientation—smooth or consolidated side—the nonwoven fabric presented. After the tensile tester has been zeroed, the friction body is placed on the platform. The nylon cord connected to the friction body is guided over the turn pulley and connected to the tensile tester. The nylon cord is sufficiently taut if the tensile tester shows a force of 0.03 N. Next the load cell of the tensile tester is zeroed again. The measurement at the tensile tester can then begin and the friction body can slide over the friction table. The mean force $F_{mittel}$ and the coefficient of friction are determined for each specimen. The force measured is determined to a precision of 0.01 N, with the calculated dynamic coefficient of friction being indicated with two decimal places.

In accordance with another concept of the invention that combines with the concepts above, but can also be farther pursued independently, a nonwoven fabric is provided with fibers that have polyethylene at least on their surface, where the nonwoven fabric has a bending stiffness in MD direction in the range of 0.03-0.23 mN/cm and in CD direction in the range of 0.01-0.15 mN/cm. The softness of the nonwoven fabric can for instance be influenced via the bending stiffness. It has proven to be advantageous for the nonwoven fabric to have a minimum and a maximum bending stiffness, since for instance in the use of the nonwoven fabric in contour matching, as in medical and hygiene articles, too stiff a material would be undesirable.

One further development provides for the nonwoven fabric to have fibers with a titer below 3 dtex, in particular below 2.8 dtex. This is an additional way to influence abrasion. In addition, another property, such as permeability for liquids and/or gases, can be affected hereby.

The nonwoven fabric preferably has a tensile force at maximum peak in CD direction of at least 3 N, preferably of at least 8 N, in particular 12 N, and in MD direction of at least 5 N, in particular of at least 10 N, preferably of at least 15N. In particular, the nonwoven fabric has a tensile force in CD direction at least 20 N high and in MD direction at least 25 N high. The tensile force is here determined following DIN/EN 29073-3, June 1992 version. However, the following deviation is adopted in the determination: the distance between the clamps is 100 mm, instead of 200 mm, as the standard states. The velocity at which a cross-head of the measurement machine is moved is of 200 mm/min, instead of 100 mm/min as defined in the standard. The specimen size is 50 mm in width and 200 mm in length. When the specimen is clamped in, care must be taken that the tension acting on the nonwoven fabric lies between 0 and 0.5N. The test is performed until the specimen tears. From the force-elongation curve so determined it is possible to determine the maximum tensile force at maximum peak and therewith the elongation at maximum force in %, the elongation at 5 N and at 10 N in % and the tensile force at 5% elongation, in Newton. The tensile force is determined with a precision of 0.1 N and the elongation with a precision of 0.1%.

According to one implementation, the nonwoven fabric exhibits a grammage of 13-30 gsm. According to another implementation, the grammage has a value of 15-20 gsm. With an appropriate embossing, at such a grammage sufficient tear forces can be made available for applications in particular in the hygiene area.

Another implementation provides for a nonwoven fabric with softness that is preferably greater than 2.1. A softness value greater than 3.1 is particularly desired.

One implementation provides for at least part of the fibers, preferably all fibers, to have a core-sheath structure. This core-sheath structure is preferably caused by different polymers. The casing can for instance be polyethylene, while the core has polypropylene. In particular, polymer mixtures can also be used here, with a core of different composition than the polymer composition of the casing. Also different polyethylene for the core and for the casing can be used. Another implementation provides for the core-sheath structure to include a light oxidation surface. In particular this oxidation surface can exist additionally. By means of an oxidation surface it is possible to improve the bonding properties in a subsequent thermal bonding step. Preferably a polypropylene has an oxidation layer on its surface.

Furthermore, the core-sheath structure can be such that for instance a multi-component material is present, in particular a two-component material, where the casing is not arranged homogeneously but inhomogeneously around the core. The arrangement can for instance be in the form of thickenings and thickness reductions. In accordance with another implementation, the casing arrangement can even be partially discontinuous, so that the core appears in at least some segments.

Besides a core-sheath structure in the form of a two-component fiber, the core-sheath structure can also be eccentric. Segment fibers can also be formed.

A further implementation provides for at least part of the fibers to have a non-circular cross-section. In particular the fiber cross-section can be oval, flattened, trilobal or in any form that increases the surface. Besides an especially large surface area, in this manner a deposit on the fiber surface can achieve better adherence, because of the enlarged surface. The fiber can preferably have a star-shaped cross-section, where a gusset is formed between two radially outward stretching segments. An active substance can for instance be placed in this gusset.

The fiber can be at least either partially or completely equipped with an additional covering. This covering can be applied on the entire surface of the nonwoven fabric. To this end, for instance foam depositions, spray depositions, wetting procedures, vapor deposition procedures, ionization procedures and/or immersion bath procedures, as well as other possibilities, can be used. The covering can be applied off-line or on-line.

In accordance with another implementation form, at least a part of the nonwoven fabric fibers, preferably all of them, can have a hollow core. In this manner it is on the one hand possible to achieve a weight reduction, while on the other the hollow core can be used to achieve certain properties. A hollow core can for instance make available an improved liquid uptake. The hollow core can also contain an active agent that is gradually released to the outside. A further development provides for at least a part of the fibers, in particular all fibers of the nonwoven fabric, to be curled. A curl can for instance be achieved by means of special heat treatments, making use of different polymers contained in a nonwoven fabric fiber. Curling can also be achieved by stretching the nonwoven fabric or respectively, its fibers. Preferably the curling is accomplished by means of a process step before, during and/or after a consolidation process, in particular a thermal bonding process to bond the nonwoven fabric fibers to each other. Another implementation provides for the nonwoven fabric to be a thermally bonded spunbonded nonwoven fabric. Another implementation provides for the nonwoven fabric to be a carded nonwoven fabric.

In accordance with another concept of the invention, a device is proposed for the manufacture of a nonwoven fabric using a polyethylene-containing polymer, with a take-down mechanism that causes the take-down of the polyethylene beneath a spinning plate, where the spinning plate has an L/D ratio of 4-9. Here the value of L refers to the length of spinning plate boring through which the polymer flows to form a thread upon exiting. The value D in turn indicates the diameter of the spinning plate boring. The boring can be manufactured by different processes.

Another implementation provides for the L/D ratio to be between 6 and 8. Yet another implementation provides for the L/D ratio to be between 4 and 6. Preferably, the L/D ratio is in between 4.5 and 9, especially between 5.5 and 7.5. In particular, the possibility exists of achieving a high spinning throughput by adapting a MFI value to the L/D ratio. In accordance with a further implementation the spinning plate temperature—and according to a continued development, also the polymer temperature before it passes through the spinning plate—is coordinated with the L/D ratio, in conjunction with the polymer material.

In addition, the spinning plate can have different configurations. For instance, the diameter D can be uniform over at least most of the length L. Here, "uniform" can mean constant, but also evenly increasing or decreasing. The diameter D can also have a narrowing in its initial range, while being nearly constant in the remaining portion. In turn, the length L is preferably such that it represents the shortest distance from one side of the spinning plate to the opposite side. In accordance with a different configuration, at least part of the spinning plate holes are not at right angles to at least the side of the spinning plate on which they open.

Another configuration provides for the neighboring holes in the spinning plate to be arranged in rows parallel to each other along one width and one length of the spinning plate.

Another implementation provides for neighboring holes in the spinning plate to be offset with respect to each other. This makes it possible for the polymer threads exiting the spinning plate borings to be exposed to a quenching agent to cool them and so that they can be stretched. In particular, the spinning plate geometry and the geometry of spinning plate boring arranged on it can be coordinated with the flow velocity of the quenching agent.

Preferably it is provided an enclosure for a take-down device for the polyethylene and the spinning plate. In particular it is provided for such an enclosure to be penetrable, at least in the area of the take-down mechanism. A further development provides for the enclosure to extend at least in part in the direction of a deposition device for the polymer threads. This makes it possible to purposefully reduce environmental influences due to the conditions surrounding the device, and thereby intentionally adjusting the temperature conditioning of the take-down of the polymer threads and thereby, cooling and stretching.

Another implementation provides for the device to have an enclosure, as housing. The enclosure preferably is under a pressure of 10-50 mbar. This allows achieving a particularly good stretching of the polymer threads. Yet another implementation provides that at least a one-sided quenching air flow be arranged beneath the spinning plate. Furthermore, a two-sided quenching flow can also be provided. The quenching air can here flow perpendicularly and/or at an angle onto the polymer threads. In particular, the quenching air can be temperature conditioned. This means that at least its temperature, but for instance also its moisture content, its velocity and hence its pressure and the volume flow, and/or other parameters, can be intentionally adjusted.

One further development provides a split quenching to be arranged underneath the spinning plate. Here, in a first step underneath the spinning plate, a first quench airflow quenches the polymer threads and stretches them. It can also be provided for an optimization of the stretching during the first quenching by heating the quenching air, so that the fiber is not cooled too fast and hence can be stretched longer. A subsequent quenching has a differently conditioned quench air, compared to the first. This conditioning is adapted to the prestretched and cooled state of the polymer threads existing at that point. The conditioning can provide for the second quenching to have a higher temperature, higher volume flow, higher flow, higher velocity and/or a different flow direction than the first quenching. According to another implementation, the second quenching has lower conditioning parameters than the first. Hence, the device preferably has at least two areas, in the zone beneath the spinning plate and to a deposition device, in particular a screen belt, in which different take-down parameters can be set. A quench differing in many ways can also be used for this purpose.

Another implementation provides for the device to be such that the take-down velocity can be adjusted in a range of 900-6000 m/min. In this manner, different procedure parameters, and polymer threads as well as polymer compositions can be processed into a nonwoven fabric. For instance, one or several compactors can be provided those are able to realize different take-down velocities. A nozzle system can also be provided to select different take-down velocities. For instance, a nozzle geometry can here be adjustably modified. A take-down velocity can also be set via different tempering and pressure settings of a quenching air. This can in particular be realized in conjunction with a changeable or different nozzle geometry. One further development for instance provides for the depressurizing of a pressurized quenching air. Depressurization can be achieved in different ways, so that different take-down velocities can thereby be set.

Another further development of the device provides for a nozzle arrangement for the flow-through of polymer threads from the spinning plate to be placed under the spinning plate, which first has a constriction, then an averaged diameter and finally, an enlargement. The nozzle arrangement can here be in one or several pieces. The nozzle arrangement can also be subdivided. Preferably the nozzle arrangement is penetrable, i.e., it allows screening the polymer threads from the device's immediate surroundings. Preferably the nozzle arrangement is such that the polymer threads enter in contact with the immediate surroundings of the device only immediately before they are deposited, for instance on a screen belt. Before that the polymer threads are only under a conditioned state, determined by the quenching air and/or other media supplied to the nozzle arrangement.

It has furthermore proven to be advantageous for the spinning plate to have at least 4500 holes/m, in particular more than 6000 holes/m and preferably, more than 7000 holes/m. Another implementation provides for the spinning plate to have a hole density of 4.5-6.3 holes/cm$^2$. The spinning holes in the spinning plate can hereby have a taper. In this manner it is possible to achieve a nozzle effect and in particular, an acceleration of the polymer material inside the spinning plate. This makes it possible to spin the polymer material into thin polymer threads.

Preferably it is preferably for the borings in the spinning plate for the flow-through of the polymer to have a diameter larger than 0.4 mm. Such a size makes it possible, on the one hand, to achieve a high throughput of polymer through the spinning plate, while on the other hand with such a size sufficiently fine nonwoven fabric threads can be obtained, preferably of less than 3 dtex, in particular of less than 2.8 dtex. The boring diameter of at least 0.4 mm also makes possible with the polyethylene-containing material to achieve throughputs higher than 100 kg/h/m and especially higher than 120 kg/h/m, in particular of more than 150 kg/h/m and preferably, of higher than 180 kg/h/m. In particular, throughputs of polyethylene-containing polymer material can be attained that exceed 200 kg/h/m and that make possible a nonwoven fabric with a titer of less than 3 and an abrasion of less than 0.4 mg/cm$^3$ at an consolidated area fraction of less than 30%, preferably less than 25%, especially less than 20%. Preferably here the borings in the spinning plate have a diameter in the range of 0.4-0.7 mm, preferably up to 0.9 mm. Preferably the boring diameter is of 0.6-0.9 mm. With a spunbond nonwoven fabric line throughputs in the range of 220-240 kg/h/m can be achieved.

An improvement in the spinning of polyethylene-containing polymer material can be achieved by a coating on the spinning plate. The coating can for instance be chromium plating. However, it can also be a PTFE treatment. Other coatings that in particular reduce adherence of polymer material, but do not impede heat passage, can also be used.

A further implementation provides for the device to include a heatable calender that is connected to the device. The calender preferably has at least a smooth-surfaced roller and an engraved roller. In accordance with a first implementation the smooth-surfaced roller and the engraved roller are heated to different extents. Preferably the smooth-surfaced roller is at a lower temperature than the engraved roller. Thermal bonding of the nonwoven fabric material is performed with the heatable calender, to set the consolidated area fraction to preferably less than 23% and in particular, to less than 20%, in particular in a range of 13-18%. Preferably it is planned that achieving the embossing after the deposition of the nonwoven fabric fibers be accomplished in a single step, in particular just by means of a heatable calender. In this implementation there is no further consolidation of the nonwoven fabric material.

The thermal bonding step can be additionally furthered by means of a coating on at least one of the calender rollers.

Preferably the coating is such that adhesion is avoided, in particular adhesion of the polymer material heated in the thermal bonding step. One calender roller can for instance have a PTFE coating.

Heating of the calender rollers is preferably accomplished by means of internal heating, for instance ensured by a liquid circulation. A calender roller can also be heated by means of gaseous media. Preferably different heating circuits are provided, so that different heating is possible in two opposing calender rollers. Preferably a temperature difference of at least 2° C. can be set, in particular a temperature difference of up to 10° C. It is also possible to heat both calender rollers to the same temperature.

Another implementation provides that the device include an arrangement that allows the manufacture of a core-sheath structure. To this end, the device preferably has a spinning plate for the generation of a core-sheath structure, in which the device generates the casing with a polyethylene-containing polymer and the core with a polypropylene-containing polymer. The spinning plate and all the remaining components of the device are adjusted for the procedural parameters necessary in each case for the different polymers. This for instance means that different temperatures, different line diameters and different polymer extruders can be made available.

According to another concept of the invention, a procedure is made available for the manufacture of a nonwoven fabric the fibers of which have polyethylene on the surface at least in parts, whereby the fibers can be further processed after take-off at a velocity of at least 650 m/min, in particular 1500 m/min from a spinning plate, where the polymer is heated in an extruder to between 200° C. and 250° C. and passed at that temperature through a spinning plate heated to between 190° C. and 240° C., where the polymer is divided into individual polymer threads in a spinning plate with a least over 4500 holes/m, where the polymer threads in each case flow through the spinning plate along a path that is at least four times as long as a polymer thread diameter. The polymer thread diameter used here is the diameter at the exit from the spinning plate.

Preferably it is provided for the polymer threads to be stretched at a take-off velocity of 3000-4500 m/min.

The polyethylene is preferably mixed as dry blend with another polymer before going into the extruder. This has shown particularly advantageous effects during processing, since thereby the throughput can be increased to over 160 kg/h/m.

One further development provides for the polymer thread to be deposited on a screen belt, to be subsequently compacted by means of a calender, the rollers of which are heated to different degrees. Consolidation occurs in a thermal bonding step. It is preferably provided for the polymer threads to be thermally bonded in a temperature range of 112-135° C., with a consolidated area fraction of less than 30%, preferably less than 28%, especially less than 23%. In particular, a nip pressure in the calender amounts to 40-80N/mm, particularly to only 40-60 N/mm.

In accordance with one implementation, a polyethylene being a homo- or a copolymer is bonded in a temperature range that can reach up to 140° C. In another implementation a Bico material is bonded in a temperature range than can reach up to 155° C.

The nonwoven fabric can be used to particular advantage in an application in which it is used on the outside of a product, as covering.

The polymer material used for the fibers can be a polyethylene by itself, or in a blend. A blend can be obtained either by compounding or by dry-blending of one or several polymers. In particular, the concept "polymer" includes homopolymers, copolymers and inter-polymers, i.e., polymers formed by polymerization of at least two different kinds of monomers. This means that the polymer material can be a copolymer, a terpolymers, etc. The polyethylene polymer can for instance be a LDPE, a LLDPE and/or a HDPE. They can be formed by homopolymerization of ethylene, or by inter-polymerization, for instance copolymerization of ethylene with one or several vinyl or diene-based comonomers. An α-polyolefin with three to twenty carbon atoms can for instance be used, or a vinyl ester, or a styrene-based monomer, as well as other copolymerization reactions.

The polyethylene that can be used can for instance be of homogeneous or inhomogeneous linkage of the molecules. In addition to using long-chain, essentially linear polyethylene, short-chain polyethylene polymers can also be used. Furthermore, both LLDPE and HDPE can be used. The polyethylene preferably has a bimodal molecular weight distribution, but the polymer or copolymer, respectively, can also have a unimodal molecular weight distribution. A polyethylene with octene, in particular a metallocene-LLDPE with octene is preferred.

It was surprisingly found that polyethylene-containing material can be used by itself or in mixtures with other polymer material in the manufacture of nonwoven fabric fibers which was used to date only in the injection molding area, especially for roto-molding, for sheets or other plastic processing areas, but not in the nonwoven fabric area.

A polymer material can for instance include a polyethylene blend by itself, or as a partial constituent, as described in US 2003/0149180. It is also possible to use homo and copolymers and polymer blends, for instance with polypropylene, as described in EP 260 974 A1, for example. Regarding the polymers necessary to manufacture nonwoven fabric fibers, their manufacture and composition, in the framework of this invention it is referred to these two documents, the content of which are part of the disclosure in this description.

It is furthermore possible to use polymer blends and polymers, in particular admixed, as known for instance from US 2002/0144384, from US 2001/0051267, from US 2002/0132923 and from US 2002/0019490. The relevant content of these documents is also part of this description, within the framework of the disclosure.

An essentially linear polyethylene can for instance be manufactured in a continuous process, with at least one reactor. Something of this type is for instance described in WO 93/07187, WO 93/07188 and WO 94/07189, the content of which is part of the description, within the framework of this disclosure. A multiple reactor arrangement can also be used, for instance as described in U.S. Pat No. 3,914,342. The disclosure made there is hereby also included in this description.

The polyethylene can for instance be manufactured using a Ziegler-Natta, or a Kaminsky-Sinn polymerization reaction. In addition, the polyethylene can be manufactured by a metallocene process. The possibility furthermore exists of manufacturing polymer mixtures by manufacturing each fraction of the mixture separately and combining them only subsequently. This has the advantage of particularly variable regulation possibilities, by changing the individual fractions. Another possibility provides for a reactor to be adjusted for a desired polyethylene-containing polymer, to be then operated continuously at this ratio.

In accordance with a first implementation, preferably a LLDPE is used that has a density preferably in the range of 0.9-0.955 g/cm$^3$. According to a different implementation, a ULDPE or a VLDPE can for instance be used, with densities in the range of 0.87-0.91 g/cm$^3$, approximately. Or a HDPE with a density of for instance 0.941-0.965 g/cm$^3$ can be used. Also PE materials with different densities mixed together can be used.

According to another implementation, a polyethylene material is used in which the $M_w/M_N$ range lies for instance between 2 and 4, in particular between 2.6 and 3.2. The material preferably has a molecular weight in the range of 40,000-55,000 g/mol, in particular of 46,000-52,000 g/mol. The density is preferably adjusted to 0.85-0.955 g/cm$^3$. The MFI preferably lies in the range of 10-30 g/10 min at 190° C./2.16 kg. It is in particular also possible to mix two or more polymers, for instance as dry blend or as compound. This material comprises preferably the same parameters as mentioned above. According to one implementation, at least one polyethylene-containing polymer has a high MFI, for instance of 30 g/10 min at 190° C./2.16 kg, with a high density, and the second polyethylene has a lower MFI, for instance of 10, and a lower density than the first one. The polymers are preferably unimodal. Another implementation provides for the use of a polyethylene-containing polymer with a density of 0.955 g/cm$^3$ and an MFI of 29 g/10 min at 190° C./2.16 kg. Another implementation comprises or consists of at least a PE polymer that has a bimodal molecular weight distribution.

In addition to polyethylene, at least one other thermoplastic material can be mixed with the polyethylene material, or arranged next to it. The thermoplastic material can for instance be a polyolefin such as polypropylene, or a polylactitol, an alkenyl-aromatic polymer, a thermoplastic polyurethane, a polycarbonate, a polyamide, a polyether, a polyvinyl chloride and/or a polyester, or other polymer materials such as block polymers and elastomers. This listing is not intended to be limiting.

In addition, a nonwoven fabric fiber can include other material fractions, for instance additives. They can be added as master batch and/or during compounding. Antioxidants and/or other additives can for instance be used. A property of the nonwoven fabric may thereby be influenced, or also by treating the nonwoven fabric with a fluid, for instance by coating, spraying, diffusion, etc.

Examples of possible additives are flame retarding additives. The possibility also exists of stabilizing the nonwoven fabric with respect to solar and other radiation, for instance heat, beta and/or gamma rays. To this end thermal and/or UV stabilizers can be used as additives (for instance HALS, hindered amine light stabilizer). There is also the possibility of using opalescent pigments, for instance. Colored additives can also be used, for instance in the form of pigments. The possibility also exists of using clarifying agents as additives, and/or nucleating additives, optical brighteners, fragrances such as perfumes, aromatic additives such as spices like vanilla, hydrophilizing agents, hydrophobing agents, fillers, titanium dioxide, and antistatic agents.

Furthermore, it is possible to use additives or coatings with antimicrobial effects, such as biostatic or biocidal additives, depending on the desired use of the invention. Some examples of substances with antimicrobial activity are Irgaguard B 1000 from Ciba Specialty Chemicals, or numerous commercially available products that contain silver ions (for instance AlphaSan RC 5000 from Milliken Chemical). Odor-controlling additives such as zeolites can also be added.

According to one implementation a polyethylene is for instance used that has a MFI of 15 g/10 min at 190° C./2.16 kg, measured following ISO 1133. The material has a density of 0.935 according to ISO 1183 and a melting point of 127° C. The Vicat softening temperature is 111° C. as measured by ISO 306 (Method A120). The crystallization temperature is 107° C. as measured by DSC. This polyethylene can be spun as homopolymer, or in combination with another polymer material. An additional polyethylene material that can be spun by itself or in a mixture, has a MFI of 27 g/10 min at 190° C./2.16 kg according to ISO 1133. The density is 0.941 g·cm$^3$ according to ASTM D-792. The DSC melting temperature is 126° C. Another polyethylene material that can be spun has a MFI of 30 g/10 min at 190° C./2.16 kg, according to ISO 1133. The density is 0.955 g/cm3 per ASTM D-792. The DSC melting temperature is 132° C. These polymers mentioned as examples were spun in some cases as homopolymers and in others as polymer mixtures with other thermoplastic materials, especially with those mentioned. Preferably these and others have molecular weights in the range of 20,000-70,000 g/mol, preferably in a range of 40,000-70,000 g/mol. The polymers can in particular also be processed in the temperature range of 190-240° C. Below other advantageous polymer materials are discussed in greater detail.

It has for instance proven to be positive to mix different polyethylene materials with each other. This can be realized as a dry blend, but also in an appropriate compounding. Advantageously this polyethylene has a different density and a different MFI than the at least second polyethylene material. It is particularly advantageous if the MFI of the material to be spun is >20.

It can furthermore be provided for various polyethylene materials to be mixed together and then adding one or more additional polymers. Two or more polyethylene materials can for instance be in a mixing ratio in a band width of 80:20 to 20:80. To this material a polypropylene can for instance be added. The polypropylene can for instance be isotactic, or also syndiotactic or atactic. It was shown to be particularly advantageous for the MFI of the material to be spun to be >25, in particular in the range of 28-35 g/10 min according to ASTM D-1238. It was also found to be particularly advantageous for the density of the material to be spun to be in the range of 0.935-0.975 g/cm$^3$.

It was furthermore shown to be advantageous to seek a MFI value >20 for the material to be spun, preferably a MFI value between 20 and 30. In this manner it becomes possible to set a spinning temperature in a range of for instance 19-225° C. In particular it thereby becomes possible to set the nip pressure in the downstream calender in a very low range. Preferably the calender nip pressure had a value in the range of 40-70 N/mm, in particular of 40-60 N/mm, at the same time achieving a stable embossing result. In particular, this makes possible a durable process able to run for several hours at constant fiber or nonwoven fabric results. It has also proven advantageous for the calender to have a roughness $R_z$ of approximately 35-50 μm, in particular of 40 μm. However, the surface roughness can also be higher or lower. If a coating is applied, for instance, it advantageously has a layer thickness of 100-200 μm. A polymer coating can for instance be provided for.

It has furthermore been shown to be advantageous for the polymer material used to have a width of molecular weight distribution $M_W/M_N$ of 2-3.5. It has also proven to be advantageous to add a master batch containing a stabilizer, for some polyethylenes or polyethylene-containing mixtures. The fraction of the master batch can here for instance be of up to 5 wt.-% of the material to be spun. It was preferably established in some tests that an addition of master batch in the range of 0.1-1.5 wt.-%, with the correspondingly lower stabilizer fraction, was sufficient.

A fluoro-elastomer can furthermore for instance be added to the polyethylene or the polyethylene copolymer. The fluoro-elastomer contributes to avoid cracking of the spinning plate. Another implementation provides for a lubricant to be added to the polymer material. The lubricant can here be added in a dry blend, or during compounding. The lubricant added can for instances be an internal, or also an external lubricant. The lubricant accomplishes a further reduction in the fiber's titer. Examples of lubricants that can be used are for instance fatty acids, for instance monoamido-fatty acids, carbonated fatty acids and fatty acid mixtures. It is furthermore possible to use polyethylene wax, montan wax and wax emulsions. Hydrocarbon wax in particular has proven advantageous as an internal lubricant.

In accordance with a further implementation, a polyethylene material is used that has an MFI value of 15-20 g/10 min at 190° C./2.16 kg for the material to be spun. This makes it possible to set a temperature at the spinning plate that is in the range for instance of 190-250° C. In particular, it also makes possible setting a nip pressure in the calender downstream that is very low. The calender nip pressure can preferably have a value of 40-60 N/mm.

An extruder temperature profile can furthermore be built in such a way that the temperature is higher in the inlet area than in the outlet area. The temperature profile can also be such that the temperature in the inlet area is lower than that in the outlet area. In addition, varying the extruder length, the temperature can for instance first increase and then decrease again.

Below some examples of experimental setups and experimental results are reported. However, they should not be considered limiting and are merely an extract of the tests performed.

Below, for instance, is described the configuration used to perform some of the spinning tests for the manufacture of two-component fibers. The tests were performed on a Reifenhäuser III beam. Two separate extruders and spinning pump systems were used. The first extruder has a screw of 150 mm diameter with different screen packs of order of magnitude 60, 180 and 250 mesh (0.16, 0.05 and 0.04 mm). The second extruder has a screw of 80 mm diameter and screen packs of order of magnitude 50 and 120 mesh (0.2 and 0.08 mm). A spinning package with a spinning plate with 5.297 holes (4.414 holes per m) was used. Each hole had a diameter of 0.6 mm and an L/D ratio of 4. The calender had a smooth-faced roller and an engraved roller, both of which were heated. The engraved roller had an oval embossing pattern, where the fraction of embossing area was 16.19%. The land area points were 0.83×0.5 mm with a depth of 0.84 mm. The temperature of each roller could be regulated separately. The nip pressure in the calender could also be adjusted. In addition, different consolidating patterns were used in this as in other calenders in other tests. Elliptical, round, diamond-shaped, rod-shaped and U-shaped patterns were used, with consolidated area fractions of 14.5-35%.

The extruder was for instance adjusted as follows:

The first extruder had an outlet temperature of 210-228° C. at the extruder head. The second extruder was operated in a temperature range of 210-230° C. at the extruder head. The temperature of the second extruder could here differ from that of the first extruder. The temperature difference used for the extruder head was for instance of 5-15° C. Good results were also obtained with Bico materials when the exit temperatures were the same.

The temperature of the spinning block was set to 220-240° C. The pressure applied to the spinning block was of 30-50 bar, but it can also be in the range of 70-100 bar. The cabin pressure was varied between 13 and 20 mbar. The quenching was performed at a temperature between 16.5 and 24° C. However, these parameters are only indicated as examples. The cabin pressure for example can have values of up to 50 mbar and beyond. The quenching temperature can also be above or below the range indicated.

Other tests were for instance performed on a Fourné line. The spinning plate used had 162 holes of capillary borings with 1.4 mm diameter each. Here the melt temperature and the spin plate temperature were varied, with especially good results obtained in the range of 205-220° C. Also used for instance was a spin pack equipped with a spinning plate with 105 holes and a capillary diameter of 0.6 mm. The LID ratio was 8.

Furthermore, the first and the second extruder were also used in the manufacture of nonwoven materials of a single material. This means that a homogeneous material was used. It was possible here to use both extruders simultaneously, or just one of them. When both extruders were used simultaneously, their parameters and in particular, their temperature profiles, were set at least approximately equal. Here the parameters could vary in the same ranges indicated above for the first extruder on the one hand, and for the second on the other.

A Lurgi-Docan line was for instance also used to perform these tests. For instance, a spinning package with 2.268 holes/m in the spinning plate was used. Temperatures between 175° C. and 269° C. were set.

Below some of the experimental results are shown. The test results are merely examples and should not be viewed as limiting.

Compilation of test results with a PE/PP Bico material

| | Versuch | | |
|---|---|---|---|
| | 324 | 331 | 352 |
| Polymer | PP1/PP1 als Vergleichsmaterial | PP1/PE1 | PP1/PE1 (50/50) |
| Basisgewicht [gsm] | 17 | 27 | 20 |
| Kalandertemperatur [° C.] | 155 | 125 | 135 |
| F [N] MD Reißfestigkeit | 43.2 | 44.74 | 38.41 |
| std. [N] | 4.93 | 5.90 | 3.73 |
| F [N] CD Reißfestigkeit | 28.50 | 25.03 | 21.89 |
| std. [N] | 2.28 | 2.37 | 1.82 |
| Elongation @ Peak [%] MD | 70.70 | 57.72 | 65.60 |
| std. [%] | 9.04 | 12.09 | 9.86 |
| Elongation @ Peak [%] CD | 72.92 | 76.23 | 71.05 |
| std. [%] | 10.69 | 9.72 | 5.91 |
| [mN cm] MD Biegesteifigkeit | 0.45 | 0.71 | 0.55 |
| std. [mN cm] | 0.14 | 0.15 | 0.15 |
| [mN cm] CD Biegesteifigkeit | 0.24 | 0.24 | 0.20 |
| std. [mN cm] | 0.09 | 0.08 | 0.05 |
| [dtex] Titre | 2.3 | 2.1 | 2.3 |
| std. [dtex] | 0.3 | 0.5 | 0.5 |
| [mg/cm$^2$] Fuzz | 0.321 | 0.973 | 0.505 |
| std. [mg/cm2] | 0.064 | 0.136 | 0.081 |
| [g/10 min] MFR | 42 | 19 | 20 |
| std. [g/10 min] | 3 | 0 | 0 |
| COF (MD) | 0.37 | 0.15 | 0.35 |
| std. | 0.09 | 0.04 | 0.03 |
| SPU Softness | 1.20 | 1.80 | 0.90 |

Versuch = test
Basisgewicht = base weight
Kalandertemperatur = calender temperature
Reissfestigkeit = tensile strength
Biegesteifigkeit = bending stiffness
Vergleichsmaterial = reference material
std. = standard deviation
PP1 = PP homopolymer with MFR of 27 according to ISO 1133 and a density of 0.9 g/cm$^3$
PE1 = resin A, see below Compilation of test results 1 with a polyethylene material

| | Versuch | | | | | | | | | |
|---|---|---|---|---|---|---|---|---|---|---|
| | 397 | 401 | 404 | 405 | 421b | 417 | 428 | 429 | 469 | 467 |
| Polymer | PP als Vergleichsmaterial | PP als Vergleichsmaterial | PE1 | PE1 | PE2 | PE2 | PE3 | PE3 | PE4 | PE4 |
| Basisgewicht [gsm] | 20 | 27 | 20 | 27 | 20 | 27 | 20 | 27 | 20 | 27 |
| Kalandertemperatur [° C.] | 145 | 155 | 130 | 130 | 135 | 135 | 125 | 125 | 130 | 140 |
| Quenchtemperatur [° C.] | 22 | 22 | 22 | 22 | 22 | 22 | 22 | 22 | 22 | 22 |
| Spaltdruck [N/mm] | 70 | 70 | 70 | 70 | 70 | 70 | 70 | 70 | 70 | 70 |
| F [N] MD Reißfestigkeit | 36.61 | 66.08 | 8.69 | 13.99 | 11.76 | 11.28 | 10.48 | 15.17 | 14.43 | 10.97 |
| std. [N] | 3.12 | 3.42 | 1.13 | 1.05 | 1.12 | 0.56 | 0.50 | 0.99 | 2.30 | 2.61 |
| Force [N] CD Reißfestigkeit | 25.63 | 46.45 | 5.70 | 9.37 | 5.85 | 9.54 | 7.22 | 12.21 | 6.37 | 10.30 |
| std. [N] | 2.92 | 1.35 | 0.66 | 0.71 | 1.13 | 0.86 | 0.73 | 0.86 | 0.99 | 1.54 |
| Elongation @ Peak [%] MD | 50.75 | 71.35 | 47.57 | 60.52 | 43.79 | 98.79 | 166.80 | 171.45 | 76.56 | 62.60 |
| std. [%] | 6.52 | 7.62 | 14.33 | 12.26 | 6.57 | 14.74 | 12.25 | 16.83 | 18.24 | 20.39 |
| Elongation @ Peak [%] CD | 52.08 | 68.31 | 50.29 | 65.40 | 82.91 | 125.78 | 151.04 | 191.59 | 94.27 | 99.18 |
| std. [%] | 7.43 | 3.77 | 9.41 | 10.66 | 16.64 | 15.61 | 25.55 | 15.73 | 20.15 | 21.93 |
| [mN cm] MD Biegefestigkeit | 0.508 | 1.426 | 0.091 | 0.206 | 0.062 | 0.135 | 0.049 | 0.135 | 0.069 | 0.061 |
| std. [mN cm] | 0.102 | 0.297 | 0.040 | 0.053 | 0.029 | 0.034 | 0.012 | 0.049 | 0.022 | 0.024 |
| [mN cm] CD Biegefestigkeit | 0.231 | 0.887 | 0.036 | 0.087 | 0.015 | 0.055 | 0.024 | 0.079 | 0.016 | 0.061 |
| std. [mN cm] | 0.048 | 0.235 | 0.014 | 0.025 | 0.013 | 0.016 | 0.009 | 0.046 | 0.006 | 0.027 |
| [dtex] Titer | 1.99 | 2.11 | 2.74 | 2.72 | 2.50 | 2.75 | 2.85 | 2.83 | 2.83 | 2.83 |
| std. [dtex] | 0.19 | 0.17 | 0.20 | 0.23 | 0.26 | 0.33 | 0.00 | 0.12 | 0.12 | 0.12 |
| [mg/cm$^2$] Abrieb | 0.605 | 0.216 | 0.386 | 0.790 | 0.459 | 0.265 | 0.559 | 0.640 | 0.538 | 0.437 |
| std. [mg/cm$^2$] | 0.109 | 0.097 | 0.190 | 0.087 | 0.069 | 0.142 | 0.093 | 0.153 | 0.123 | 0.034 |
| COF MD | 0.290 | 0.309 | 0.307 | 0.271 | 0.415 | 0.318 | 0.374 | 0.370 | 0.366 | 0.315 |
| std. COF | 0.012 | 0.013 | 0.006 | 0.016 | 0.013 | 0.023 | 0.014 | 0.015 | 0.018 | 0.010 |

als Vergleichsmaterial = as comparison material

Basisgewicht = base weight

Kalandertemperatur = calender temperature

Quenchtemperatur = quenching temperature

Spaltdruck = gap pressure

Reissfestigkeit = tensile strength

Biegefestigkeit = bending stiffness

Abrieb = abrasion std = standard deviation

PP = PP1 = PP homopolymer with MFR of 27 (190° C./2.16 kg) according to ISO 1133 and a density of 0.9 g/cm$^3$ according to ISO 1183

PE1 = resin A, see below

PE2 = resin D, see below

PE3 = resin E, see below

PE4 = resin G, see below

Compilation of test results 2 with a polyethylene material

| | Versuch | | | | | |
|---|---|---|---|---|---|---|
| | 512_3Z W | 488 | 489 | 490 | 497 | 545_7d |
| Polymer | PE5 | PE5 | PE5 | PE5 | PE5 | PE5 |
| Bonding Muster | 3 zones | Oval | Oval | Oval | Oval | 70 dots |
| Bonding Flache [%] | 25 | 16.19 | 16.19 | 16.19 | 16.19 | 14.5 |
| Basisgewicht [gsm] | 20 | 20 | 20 | 20 | 20 | 20 |
| Kalandertemperatur [° C.] | 125 | 125 | 130 | 135 | 130 | 125 |
| Quenchtemperatur [° C.] | 22 | 22 | 22 | 22 | 22 | 22 |
| Spaltdruck [N/mm] | 40 | 40 | 40 | 40 | 60 | 50 |
| F [N] MD Reißfestigkeit | 13.41 | 10.53 | 14.23 | 14.67 | 14.84 | 14.62 |
| std. [N] | 0.65 | 4.51 | 1.72 | 1.34 | 1.21 | 0.83 |

-continued

Compilation of test results 2 with a polyethylene material

| | Versuch | | | | | |
|---|---|---|---|---|---|---|
| | 512_3Z W | 488 | 489 | 490 | 497 | 545_7d |
| F [N] CD Reißfestigkeit | 8.36 | 4.51 | 6.37 | 8.24 | 7.34 | 10.67 |
| std. [N] | 0.46 | 1.59 | 1.65 | 1.07 | 0.44 | 1.22 |
| Elongation @ Peak [%] MD | 112.42 | 41.18 | 70.46 | 72.22 | 77.86 | 105.28 |
| std. [%] | 6.03 | 20.73 | 14.47 | 12.33 | 9.01 | 9.52 |
| Elongation @ Peak [%] CD | 135.27 | 64.46 | 85.64 | 98.76 | 95.88 | 122.49 |
| std. [%] | 12.52 | 17.24 | 19.35 | 14.71 | 8.16 | 13.06 |
| [mN cm] MD Biegefestigkeit | 0.022 | 0.049 | 0.047 | 0.067 | 0.062 | 0.045 |
| std. [mN cm] | 0.006 | 0.010 | 0.014 | 0.040 | 0.019 | 0.018 |
| [mN cm] CD Biegefestigkeit | 0.011 | 0.017 | 0.020 | 0.018 | 0.019 | 0.015 |
| std. [mN cm] | 0.006 | 0.007 | 0.005 | 0.009 | 0.007 | 0.003 |
| [dtex] Titer | | 2.72 | 3.15 | 2.87 | 2.98 | 2.58 |
| std. [dtex] | | 0.23 | 0.22 | 0.47 | 0.37 | 0.27 |
| [mg/cm$^2$] Abrieb | 0.103 | 0.097 | 0.131 | 0.199 | 0.185 | 0.332 |
| std. [mg/cm$^2$] | 0.059 | 0.029 | 0.076 | 0.097 | 0.107 | 0.184 |
| COF MD | 0.372 | 0.444 | 0.416 | 0.376 | 0.318 | 0.455 |
| std. COF | 0.046 | 0.010 | 0.010 | 0.044 | 0.045 | 0.005 |

Versuch = test
Muster = pattern
Fläche = surface area
Basisgewicht = base weight
Kalandertemperatur = calender temperature
Quenchtemperatur = quenching temperature
Spaltdruck = nip pressure
Reissfestigkeit = tensile force
Biegefestigkeit = bending stiffness
Abrieb = abrasion
std = standard deviation
PE5 = metallocene LLDPE with MFR of 15 g/10 min (190° C./2.16 kg) according toISO 1133 and density of 0.935 g/cm$^3$ according to ISO 1183

Further examples are:

A series of fibers were used to make a series of nonwoven fabrics. The resins were as follows: Resin A is an ethylene homopolymer having a melt index ($l_2$) of 30 gram/10 minutes and a density of 0.955 g/cc. Resin B is an ethylene homopolymer having a melt index ($l_2$) of 27 gram/10 minutes and a density of 0.941 g/cc. Resin C is a homogeneous substantially linear ethylene/a-olefin having a melt index ($l_2$) of 30 gram/10 minutes and a density of 0.913 g/cc. Resin D is an ethylene/1-octene copolymer, comprising about 40% (by weight) of a substantially linear polyethylene component having a melt index of about 30 g/10 minutes and a density of about 0.915 g/cc and about 60% of a heterogenous Ziegler Natta polyethylene component; the final polymer composition has a melt index of about 30 g/10 minutes and a density of about 0.9364 g/cc. Resin E is an ethylene/1octene copolymer, comprising about 40% (by weight) of a substantially linear polyethylene component having a melt index of about 15 g/10 minutes and a density of about 0.915 g/cc and about 60% of a heterogenous Ziegler Natta polyethylene component; the final polymer composition has a melt index of about 22 g/10 minutes and a density of about 0.9356 g/cc. Resin F is an ethylene/1-octene copolymer, comprising about 40% (by weight) of a substantially linear polyethylene component having a melt index of about 15 g/10 minutes and a density of about 0.915 g/cc and about 60% of a heterogenous Ziegler Natta polyethylene component; the final polymer composition has a melt index of about 30 g/10 minutes and a density of about 0.9367 g/cc. Resin G is an ethylene/1-octene copolymer, comprising about 55% (by weight) of a substantially linear polyethylene component having a melt index of about 15 g/10 minutes and a density of about 0.927 g/cc and about 45% of a heterogenous Ziegler Natta polyethylene component; the final polymer composition has a melt index of about 20 g/10 minutes and a density of about 0.9377 g/cc. Resin H is homopolymer polyproylene having a melt flow rate of 25 g/10 minutes in accordance with ASTM D-1238 condition 230° C./2.16 kg.

Resins D, E, F, and G can be made according to U.S. Pat. Nos. 5,844,045, 5,869,575, 6,448,341, the disclosures of which are incorporated herein by reference. Melt index is measured in accordance with ASTM D-1238, condition 190° C./2.16 kg and density is measured in accordance with ASTM D-792.

Nonwoven fabric was made using the resins indicated in the table mentioned below and evaluated for spinning and bonding performance. The trials were carried out on a spunbond line which used a Reicofil III technology with a beam width of 1.2 meters. The line was run at an output of 107 kg/hour/meter (0.4 g/min/hole) for all polyethylene resins and 118 kg/hour/meter (0.45 g/min/hole) with the polypropylene resin. Resins were spun to make about 2.5 denier fibers, corresponding to the fiber velocity of about 1500 m/min at 0.4 g/min/hole output rate. A mono spin pack was used in this trial, Each spinneret hole had a diameter of 0.6 mm (600 micron) and a L/D ratio of 4. Polyethylene fibers were spun at a melt temperature of 210° C. to 230° C. and polypropylene fibers were spun at a melt temperature of about 230° C.

The embosses roller of the chosen calendar had an oval pattern with a bonding surface of 16.19%, an areas amount/cm$^2$ of 49.90, a land are width of 0.83 mm×0.5 mm and a depth of 0.84 mm.: For the polypropylene resin the embossed calendar and smooth roller were set at the same oil temperature. For polyethylene resins the smooth roller was set 2° C. lower than the embossed roller (this was to reduce tendency of roller wrap). All calendar temperatures that are mentioned in this report were the oil temperature of the embossed roll. The surface temperatures on the calendars were not measured. The nip pressure was maintained at 70 N/mm for all the resins.

| Example # | Resin | Basis Weight [gsm] | Bonding Temp ° C. | Mono or bicomponent filament | Abrasion (mg/cm$^{2)}$ | Flexural Rigidity (nMcm) MD; CD | Elongation to Peak Force % | Tenacity (N/5 cm); MD; CD | Softness (SPU) |
|---|---|---|---|---|---|---|---|---|---|
| 1 | 100% H | 20 | 145 | mono | 0.183 | 0.7; 0.3 | 63.8; 78.25 | 49.73; 37.18 | 0.7 |
| 2 | 100% A | 20 | 130 | Mono | 0.997 | 0.13; 0.05 | 24.95; 32.93 | 9.32; 4.10 | 2.3 |
| 3 | 100% A | 28 | 130 | Mono | 0.997 | 0.26; 0.14 | 65.07; 72.81 | 20.37; 11.42 | 2.2 |
| 4 | 100% B | 21 | 125 | Mono | 0.678 | 0.08; 0.03 | 32.63; 45.06 | 11.08; 5.56 | 2.7 |
| 5 | 100% B | 28 | 125 | Mono | 1.082 | 0.15; 0.08 | 37.83; 47.48 | 16.23; 8.1 | 2.6 |
| 6 | 80% A/20% C Compounded | 21 | 130 | Mono | 0.53 | 0.06; 0.03 | 63.14; 91.56 | 12.0; 8.8 | 2.9 |
| 7 | 80% A/20% C Compounded | 28 | 130 | Mono | 0.56 | 0.16; 0.07 | 86.02; 109.51 | 17.79; 13.22 | 2.4 |
| 8 | 80% A/20% C Dry Blended | 21 | 130 | Mono | 0.42 | 0.07; 0.03 | 57.98; 86.16 | 11.45; 8.15 | 3 |
| 9 | 100% D | 20 | 135 | Mono | 0.399 | 0.07; 0.02 | 71.3; 100.16 | 7.25; 5.90 | 3 |
| 10 | 100% D | 27 | 135 | Mono | 0.491 | 0.14; 0.06 | 98.79; 125.78 | 11.28; 9.54 | NA |
| 11 | 100% E | 20 | 135 | Mono | 0.411 | 0.08; 0.03 | 69.35; 97.99 | 7.30; 6.09 | 3.9 |
| 12 | 100% E | 27 | 135 | Mono | 0.653 | 0.22; 0.07 | 89.60; 123.71 | 11.33; 9.76 | NA |
| 13 | 100% F | 20 | 135 | Mono | 0.421 | 0.09; 0.03 | 75.04; 105.15 | 7.02; 6.15 | 3.7 |
| 14 | 100% F | 27 | 135 | Mono | 0.534 | 0.22; 0.07 | 93.45; 118.21 | 11.36; 9.21 | NA |
| 15 | 100% G | 20 | 135 | Mono | 0.435 | 0.08; 0.03 | 59.55; 96.78 | 8.25; 7.12 | NA |
| 16 | 100% G | 27 | 135 | Mono | 0.625 | 0.19; 0.06 | 95.89; 116.26 | 13.23; 11.13 | NA |

In addition, the nonwoven fabric manufactured can be used by itself, or for instance in combination with other nonwoven fabrics or materials such as films. In particular, it can be combined to form a composite material. After its manufacture, the mono or multilayered nonwoven fabric can be additionally consolidated, bonded, laminated and/or mechanically treated, in particular composited with another material. This can for instance be accomplished physically, chemically, frictionally coupled and/or interlocking. For instance, thermal and/or ultrasonic bonding possibilities may be used. An adhesive can also be used.

Preferably the nonwoven fabric can be included in a SM or SMS material, for instance as known from U.S. Pat. Nos. 5,178,931 and 5,188,885, or with a melt-blown material, as for instance known from U.S. Pat. Nos. 3,704,198 and 3,849,241. Multilayer materials can also be formed, for instance as known from WO 96/19346. In the context of this disclosure of the invention we refer to the documents indicated above, with regard to the material, the manufacturing process and/or its use. It is also possible to manufacture two-component materials, for instance as they are known from U.S. Pat. Nos. 5,336,552, 5,382,490, 5,759,926 and 5,783,503 and the documents mentioned therein. It is also possible to manufacture co-extruded fibers as they are known from U.S. Pat. Nos. 4,100,324 and 4,818,464.

Furthermore, the nonwoven fabric can be stretched by itself or bonded to at least one additional layer. Here the material can exhibit elastic properties. The stretching force can here be applied in CD and/or in MD. Methods and parameters for such stretching can for instance be found in EP 0 259 128 B1, in U.S. Pat. No. 5,296,184, in EP 0 309 073 and in U.S. Pat. No. 5,770,531. It is referred to them in the context of this disclosure in relation to stretch possibilities.

The term "nonwoven fabric" refers to a web that has a structure of individual fibers or threads which are interlaid, but not in any regular, repeating manner. Nonwoven fabrics can be formed by a variety of processes, such as, for example, air laying processes, meltblowing processes, spunbonding processes and carding processes, including bonded carded web processes.

The nonwoven fabric might comprise microfibers. "Microfibers" refers to small diameter fibers having an average diameter not greater than about 100 microns. Fibers, and in particular, spunbond fibers utilized in the present invention can be microfibers, or more specifically, they can be fibers having an average diameter of about 15-30 microns, and having a denier from about 1.5-3.0.

The nonwoven fabric might comprise meltblown fibers. The term "meltblown fibers", refers to fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter, which may be to a microfiber diameter. Thereafter, the meltblown fibers are carried by the high velocity gas stream and are deposited on a collecting surface to form a web of randomly dispersed meltblown fibers.

The nonwoven fabric might comprise spunbond fibers, especially consists spun-bond fibers. The term "spunbonded fibers" refers to small diameter fibers which are formed by extruding a molten thermoplastic material as filaments from a plurality of fine, usually circular, capillaries of a spinneret with the diameter of the extruded filaments then being rapidly reduced by drawing.

The nonwoven fabric might be consolidated. The terms "consolidation" and "consolidated" refer to the bringing together of at least a portion of the fibers of the nonwoven fabric into closer proximity to form a site, or sites, which function to increase the resistance of the nonwoven to external forces, e.g., abrasion and tensile forces, as compared to the unconsolidated fabric. "Consolidated" can refer to the entire nonwoven fabric that has been processed such that at least a portion of the fibers are brought into closer proximity, such as by thermal point bonding. Such a web can be considered a "consolidated web". In another sense, a specific, discrete region of fibers that is brought into close proximity, such as an individual thermal bond site, can be described as "consolidated".

Consolidation can be achieved by methods that apply heat and/or pressure to the fibrous web, such as thermal spot (i.e., point) bonding. Thermal point bonding can be accomplished by passing the fibrous web through a pressure nip formed by two rolls, one of which is heated and contains a plurality of raised points on its surface, as is described in the aforementioned U.S. Pat. No. 3,855,046 issued to Hansen et al. Consolidation methods can also include ultrasonic bonding, through-air bonding, and hydroentanglement. Hydroentanglement typically involves treatment of the fibrous web with high pressure water jets to consolidate the web via mechanical fiber entanglement (friction) in the region desired to be consolidated, with the sites being formed in the area of fiber entanglement. The fibers can be hydro-entangled as taught in U.S. Pat. Nos. 4,021,284 issued to Kalwaites on May 3, 1977 and 4,024,612 issued to Contrator et al. on May 24, 1977, both of which are hereby incorporated herein by reference. In the currently preferred embodiment, the polymeric fibers of the nonwoven are consolidated by point bonds, sometimes referred to as "partial consolidation" because of the plurality of discrete, spaced-apart bond sites.

Because of its characteristics, the nonwoven fabric can be used in the most varied applications, which are here reflected merely as examples, without claim to completeness.

The nonwoven fabric can be used in absorbent articles. The term "absorbent article" refers to devices which absorb and contain body exudates, and, more specifically, refers to devices which are placed against or in proximity to the body of the wearer to absorb and contain the various exudates discharged from the body. The nonwoven fabric can also be used in disposable articles. The term "disposable" is used herein to describe absorbent articles which are not intended to be laundered or otherwise restored or reused as an absorbent article (i.e., they are intended to be discarded after a single use and, preferably, to be recycled, composted or otherwise disposed of in an environmentally compatible manner). A "unitary" absorbent article refers to absorbent articles which are formed of separate parts united together to form a coordinated entity so that they do not require separate manipulative parts like a separate holder and liner.

Further use of the nonwoven fabric is possible: In the medical area, for instance in a Stoma bag, coverings, gowns, face masks, ladies' and babies' hygiene articles, for instance back sheets, or also as top sheets, which for instance may also have a coating, in sanitary towels, incontinence articles, printable coverings, protective surfaces, packaging materials, as separators, as vapor-permeable but water-tight materials, as adhesive material for instance in the use of microloops and locking devices, as fastening material in closure systems, as contact surface for an adhesive, as contact agent between two surfaces, for instance a bed and a bed cover, as part of a wall hanging or carpet or floor material, as cleaning or polishing agent, in protective clothing, for instance an overall, in applications close to the skin. Also as oil and/or lubricant collector and/or as cleaning agent, in sport clothes, sport accessories and/or sport equipment, or shoes, in clothing items such as gloves, coats, etc., as packaging, for instance for bottles, CD wrappers, as wrapping, as decoration, in the automobile domain, in the fittings area, as covering material to wrap articles, as a coating, as roofing material, as noise and/or thermal insulation, as filtering agent or sedimentation agent, as identification agent for instance in creme application fabrics, as storage medium for substances that during subsequent use are suddenly or gradually released, for instance by diffusion, as eyeglass cleaning fabric, as loading medium for particles and/or powders, as intermediate layer in hygiene articles, in the sanitary area, for instance in towels, in bathing caps, as drainage agent, as color-coding agent, as signal marker, as seat cover, as wound covering material, in elastic bandages, as cigarette filter, as surface material in a disposable article, as covering material for painting, coating and similar work, to grow cell cultures, in elastic materials, for instance in hygiene articles as sidebands, waste-bands and/or also elastic closures, in suction pads, as well as in other applications, e.g. house-hold applications like wipes, especially wipes comprising or consisting of at least one nonwoven fabric layer as mentioned

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Other advantageous implementations and further developments can for instance be derived from the drawings below. The examples there illustrated should not be viewed as limiting. The characteristics described there can rather be related to other implementation forms.

Figure 2:
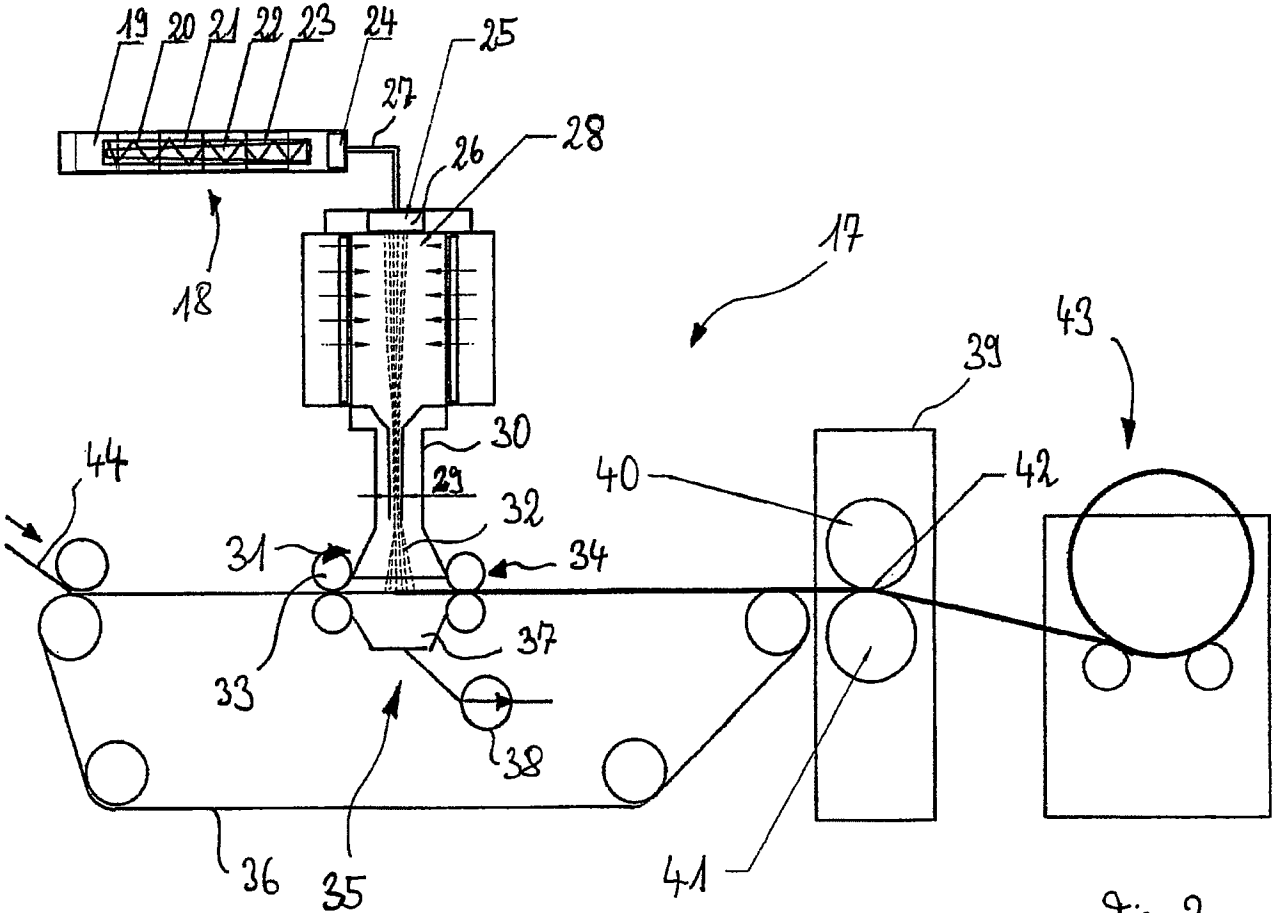
Figure 3:
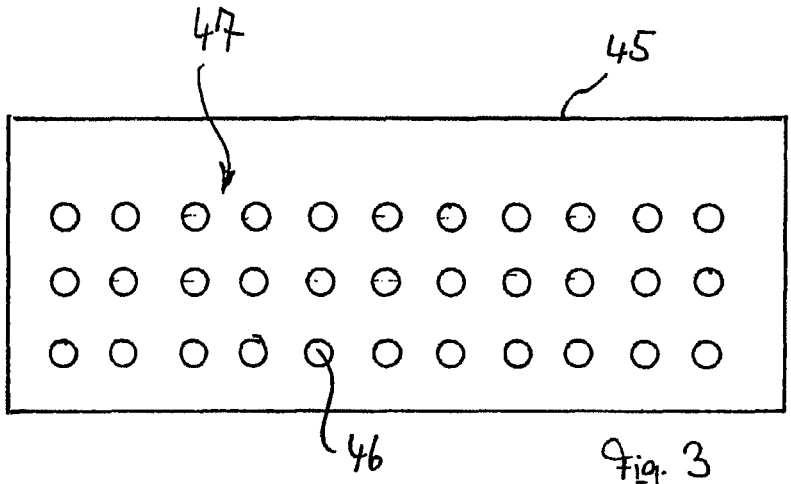
Figure 4:
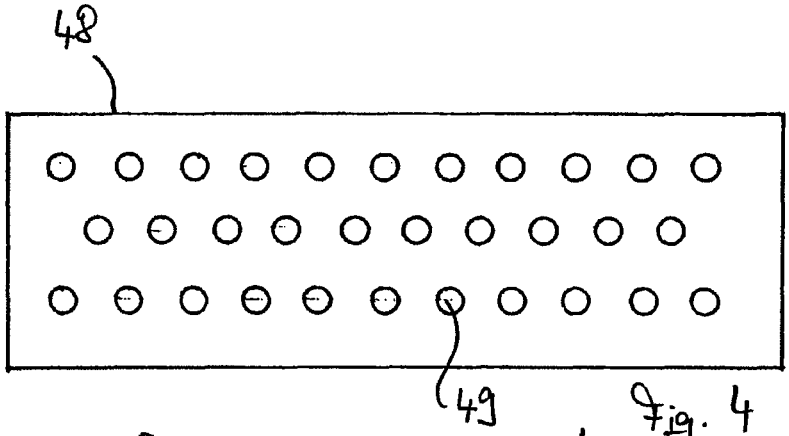
Figure 5:
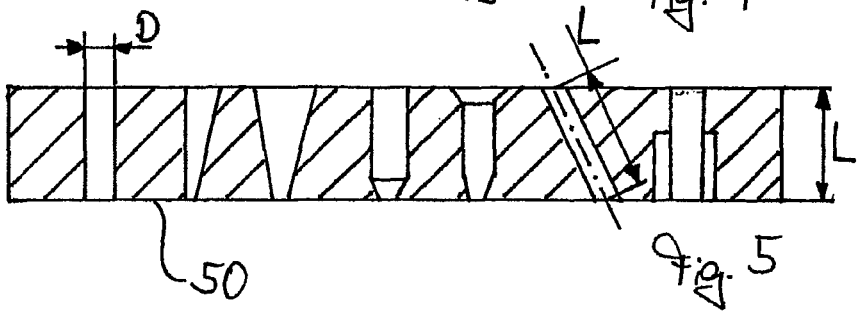
Figure 6:
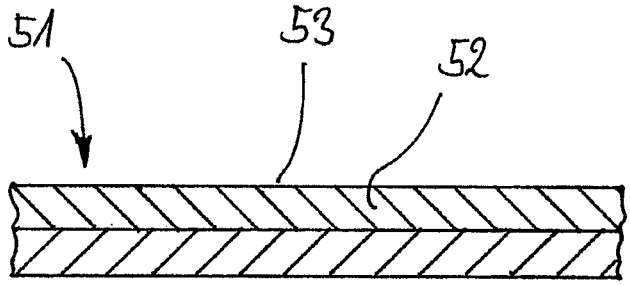
Figure 7:
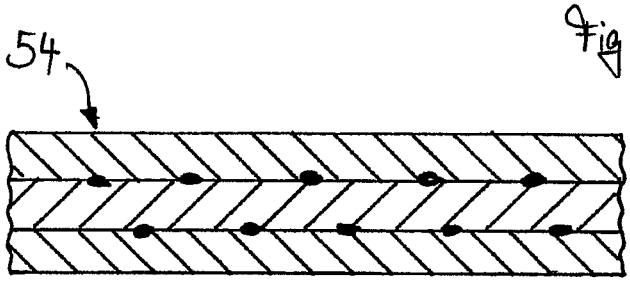
Figure 8:
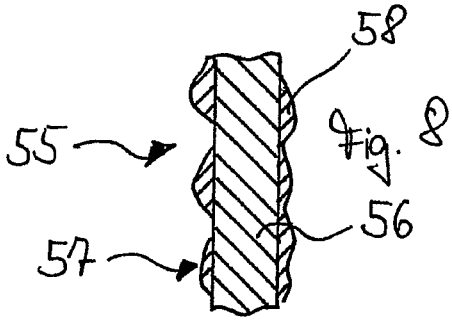
Figure 9:
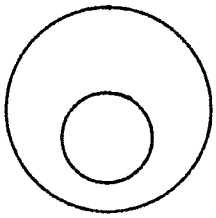
Figure 10:
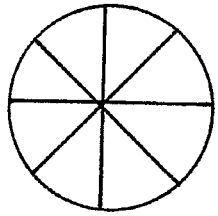
Figure 11:
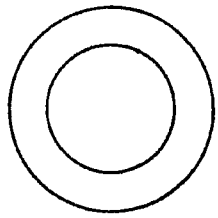

FIG. 1: is a schematic view showing a first spinning system that operates according to the Lurgi-Docan process, FIG. 2: is a schematic view showing a second device for the manufacture of spunbond nonwoven fabrics, FIG. 3: is a top view showing a first spinning plate, FIG. 4: is a top view showing a second spinning plate, FIG. 5: is a cross-section all view, FIG. 6: a cross sectional view of a first product, FIG. 7: cross sectional view of a second product, FIG. 8: a cross-section through a nonwoven fabric fiber, and FIGS. 9, 10, 11: a cross-section through bicomponent fibers.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 shows a first device 1 for the manufacture of nonwoven fabric fibers 2. In an extruder 3, polymer sent to the extruder 3 is melted and sent to a spinning package 5 through an extruder head 4. The extruder head 4 and the spinning package 5 can be heated independently of each other. A spinning plate 6 is included in the spinning package 5. The polymer 7 coming from the extruder is pressed through the spinning plate 6. As it exits the spinning plate 6, the polymer continues as individual threads, which are cooled and stretched by means of quenching device 8. The quenching device provides for a quenching medium 9, indicated by arrows, to cool the polymer threads 10 coming out of the spinning plate 6. After passing through this one-piece quenching segment 11, the polymer threads 10 are sent into a gap area 12. In the gap area 12 first a propelling agent is introduced, for acceleration. In particular this can be driving air. Farther downstream a spreading medium 14 is introduced, to spread the polymer threads 10 in a downstream diffuser area 15. The nonwoven fabric fibers 16 thus stretched and spread can then be deposited on a device not further shown, for further processing. With the device described and properly chosen parameters it is possible to manufacture a nonwoven fabric as described above. To this end a bonding facility is added downstream of the first device 1, in particular a calender system, so that the nonwoven fabric can be manufactured in a single process, from polymer melting to processing to nonwoven fabric fibers, to consolidation in a calendering system.

FIG. 2 shows a second device 17, that includes an extruder 18. The extruder 18 has a first segment 19, a second segment 20, a third segment 21, a fourth segment 22 and a fifth segment 23. The segments 19-23 can each be heated separately. In addition, the extruder 18 has a heated extruder head 24. The melted polymer is sent under temperature control to the spinning package 25, through the extruder head. The polymer 27, under pressure, is sent to the chamber 28 via the spinning package 25 and through the spinning plate 26 that is part of the spinning package 25. The chamber 28 has an outlet placed across from the spinning package 25. This outlet can in particular be in the form of a gap, as illustrated. In particular, the gap width 29 is adjustable. The outlet 28 preferably opens into an enclosure 30 that preferably has a diffuser area 31. The diffuser area 31 allows spreading the nonwoven fabric fibers 32 when they are deposited. Next to the diffuser area and in particular, preferably sealed off of it, a first 33 and a second roller area 34 is arranged. The roller areas 33, 34 are preferably such that they facilitate improved suctioning off of the quenching medium by the deposition facility 35. In particular, a suction system 37 can be arranged underneath the screen belt 36 of the deposit facility 35. The suction system 37 can preferably be adjusted to different removal volumes, by changes of the suction mechanism 38. The deposited nonwoven fabric fibers 32 are next compacted or consolidated in a calender 39, in particular thermally bonded. To this end the calender 39 has an engraved roller 40 and a smooth-surfaced roller 41. Between the engraved roller 40 and the smooth-surfaced roller 41 an embossing gap 42 is formed, where its nip pressure can be adjusted. The nonwoven fabric can be spooled on a downstream spooling device 43 and stored or further processed as a spool.

On the screen belt 36, upstream of the second device 17, it is possible to install a not further illustrated let-off device, or some other layer manufacturing system. It would thereby be possible in an in-line process, for instance, to supply a support 44, on which the spunbound nonwoven fabric could be deposited and subsequently bonded.

FIG. 3 shows a first spinning plate 45 in a schematic view. The borings 46 in the spinning plate 45 are arranged in parallel rows and lines perpendicular to each other. In particular, only the borings, or also the entire spinning plate can have a coating 47.

FIG. 4 shows a second spinning plate 48 in a schematic view. Here the borings are arranged in a staggered fashion. As shown, the distances can be displaced by 50%. However, the distances can also be different, for instance ⅓, ¼ or ⅕.

FIG. 5 shows a schematic cross-section through as third spinning plate. Different boring geometries that can be used are here shown in simplified form. In addition, the L/D ratio can be obtained from the cross-section. If the diameter D changes along the length L, then the mean diameter is determined. It is obtained by adding all partial diameters and multiplying by the corresponding partial lengths and next dividing the result by the overall length L.

FIG. 6 shows a cut-out of a first product 51. The product 51 has a polyethylene nonwoven fabric 52 according to the invention on its surface 53. The product can for instance be a two-layer material, as shown. The laminate can for instance be a film/nonwoven fabric laminate.

FIG. 7 shows a cut-out of a second product 54. The second product 54 is a SMS material, for instance, the layers of which are thermally bonded to each other. Preferably the layers have not only been bonded to each other but also individually consolidated, in a single process. Here at least one of the spunbound nonwoven fabric layers is a nonwoven fabric according to the invention, with a polyethylene surface.

FIG. 8 shows a cross-section through a nonwoven fabric fiber 55. It shows a core 56 that preferably contains polypropylene. A surface 57 of the nonwoven fabric fiber has polyethylene at least on parts of it. The polyethylene can cover the entire surface, in particular with changing surface geometry, or cover the core 56 discontinuously, as casing 58. If there are discontinuities, they can advantageously be equipped with an oxidation layer, for thermal bonding.

FIGS. 9, 10 and 11 each show different cross-sections through a two-component fiber. In addition to being a fully polyethylene material-covered fiber, the two-component fiber offers the advantage of allowing the influencing of desired properties of the nonwoven fabric by the choice of the other polymers, for instance the tensile strength. In the nonwoven fabric fiber show, polyethylene forms the surface, at least partially and in particular, completely.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A nonwoven fabric comprising fibers which consist essentially of polyethylene, wherein the nonwoven fabric is thermally bonded only once and the nonwoven fabric has (i) a consolidated surface having an abrasion resistance rate less than 0.2 mg/cm$^2$ and a consolidation fraction of less than 23%, and (ii) an opposite smooth surface; wherein the nonwoven fabric has a difference in abrasion resistance between the consolidated surface and the smooth surface being less than 70% and more than 30%, said nonwoven fabric also having a dynamic friction coefficient of between 0.19 and 0.5 and a basis weight of 13-30 gsm.

2. A nonwoven fabric according to claim 1, where the nonwoven fabric has a bending stiffness in MD direction in the range of 0.03-0.23 mN/cm and in CD direction, in the range of 0.01-0.15 mN/cm.

3. A nonwoven fabric according to claim 1, wherein the fibers of the nonwoven fabric has a titer of less than 3 dtex.

4. A nonwoven fabric according to claim 1, wherein the nonwoven fabric has a tensile force in the CD direction of at least 3 N and in the MD direction, of at least 5 N.

5. A nonwoven fabric according to claim 1, wherein the nonwoven fabric has a tensile force in the CD direction of at least 8 N and in the MD direction, of at least 12 N.

6. A nonwoven fabric according to claim 1 wherein the fibers form a thermally bonded spunbound nonwoven fabric.

7. A nonwoven fabric according to claim 1 wherein the fibers form a carded or an airlaid nonwoven fabric.

8. A nonwoven fabric according to claim 1 wherein the nonwoven fabric has a basis weight of 15 to 20 gsm.

9. A nonwoven fabric according to claim 1 wherein the fibers have a hollow core.

10. A nonwoven fabric according to claim 1 wherein the fibers have a curled structure.

11. A nonwoven fabric according to claim 1 wherein the nonwoven fabric has an abrasion resistance rate less than 0.2-mg/cm$^2$ and a consolidation fraction of less than 16%.

12. A nonwoven fabric according to claim 1 wherein the nonwoven fabric has an abrasion resistance rate less than 0.1-mg/cm$^2$ and a consolidation fraction of less than 16%.

13. A nonwoven fabric according to claim 1, wherein the consolidated surface of the fabric comprises an outer layer of a product formed therefrom.

14. A nonwoven fabric comprising fibers which consist essentially of polyethylene, wherein the nonwoven fabric is thermally bonded only once and the nonwoven fabric has (i) a consolidated surface having an abrasion resistance rate less than 0.2 mg/cm$^2$ and a consolidation fraction of less than 23%, and (ii) an opposite smooth surface; wherein the nonwoven fabric has a difference in abrasion resistance between the consolidated surface and the smooth surface being less than 70% and more than 30%, said nonwoven fabric also having a dynamic friction coefficient of between 0.19 and 0.5 and a basis weight of 13-30 gsm, and wherein the nonwoven fabric has a bending stiffness in MD direction in the range of 0.03-0.23 mN/cm and in CD direction, in the range of 0.01-0.15 mN/cm;

a basis weight of between 13 gsm and 30 gsm; and the fibers of the nonwoven fabric has a titer of less than 3 dtex.

* * * * *

UNITED STATES PATENT AND TRADEMARK OFFICE

CERTIFICATE OF CORRECTION

PATENT NO. : 8,420,557 B2
APPLICATION NO. : 11/425340
DATED : April 16, 2013
INVENTOR(S) : Haberer et al.

It is certified that error appears in the above-identified patent and that said Letters Patent is hereby corrected as shown below:

On the Title page,
Item [73] Assignee: "Fiberweb Corovin GmbH" should read --Fitesa Germany GmbH--.

In the Specification
Column 4,
Line 17, "$W_{Viles}$" should read --$W_{Vlies}$--;
Line 48, "farther" should read --further--.

Column 14,
Line 10, "LID ratio" should read --L/D ratio--.

Column 23,
Line 21 and 22, "diffuser", both occurrences, should read --diffusor--.

Signed and Sealed this
First Day of October, 2013

Teresa Stanek Rea
*Deputy Director of the United States Patent and Trademark Office*